US005246905A

United States Patent [19]

Sekine et al.

[11] Patent Number: 5,246,905

[45] Date of Patent: Sep. 21, 1993

[54] THERMOSENSITIVE RECORDING MATERIAL

[75] Inventors: Mikiya Sekine; Hidetaka Tsukada, both of Tokyo, Japan

[73] Assignee: Mitsubishi Paper Mills Limited, Tokyo, Japan

[21] Appl. No.: 813,028

[22] Filed: Dec. 24, 1991

[30] Foreign Application Priority Data

Dec. 28, 1990 [JP] Japan ..... 2-415898

[51] Int. Cl.[5] ..... B41M 5/30

[52] U.S. Cl. ..... 503/208; 503/217; 503/221

[58] Field of Search ..... 503/217, 204, 218, 221, 503/225, 208; 427/150-152

[56] References Cited

U.S. PATENT DOCUMENTS

| | | | |
|---|---|---|---|
| 4,521,793 | 6/1985 | Kabashima et al. | 503/201 |
| 4,880,767 | 11/1989 | Hiraishi et al. | 503/217 |

FOREIGN PATENT DOCUMENTS

| | | | |
|---|---|---|---|
| 58-54085 | 3/1983 | Japan | 503/201 |
| 58-104959 | 6/1983 | Japan | 503/201 |
| 59-149388 | 9/1983 | Japan | 503/201 |
| 59-115887 | 7/1984 | Japan | 503/201 |
| 59-115888 | 7/1984 | Japan | 503/201 |

*Primary Examiner*—Pamela R. Schwartz
*Attorney, Agent, or Firm*—Cushman, Darby & Cushman

[57] ABSTRACT

A thermosensitive recording material which contains an aromatic isocyanate compound, an imino compound having at least one >C=NH group capable of reacting therewith upon heating to develop a color, fluoran compound I represented by the formula:

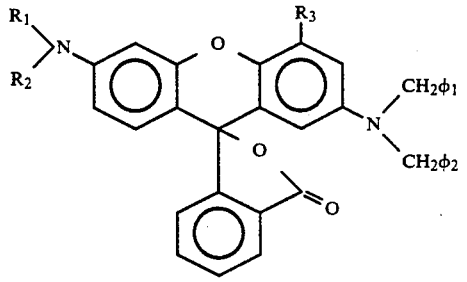

I and a fluoran compound II represented by the formula:

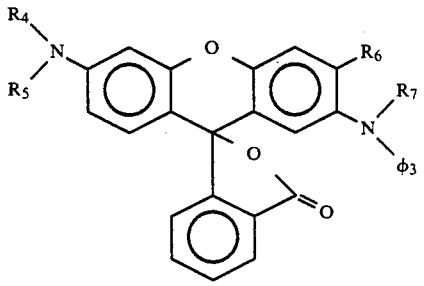

II

4 Claims, No Drawings

THERMOSENSITIVE RECORDING MATERIAL

BACKGROUND OF THE INVENTION

1. Field of the Invention

The present invention relates to a thermosensitive recording material which develops an image successfully toned to black and exhibits excellent image preservability, and which shows an improved heat response (sensitivity) while effectively inhibiting the discoloration of background caused by exposure to light.

2. Related Art

Thermosensitive recording materials generally comprise a substrate and, provided thereon, a thermosensitive recording layer comprising an electron-donative colorless dye precursor and an electron-accepting color developer as the main components; the colorless dye precursor and the color developer react instantaneously with each other when heated with a thermal head, thermal pen, laser beam, etc. to develop an image. Such materials are disclosed, for example, in GB 1135540-A, CA 835302A and the like.

Such thermosensitive recording materials have advantages in that recording can be performed with a relatively simple device which is easy to maintain and free from noise. Accordingly, they are in use over a wide field of applications including recorders, facsimiles, printers, computer terminals, labels, and automatic ticket vendors.

While the thermosensitive recording materials using an electron-donative colorless dye precursor and an electron-accepting color developer mentioned above have favorable characteristics including good appearance, good feel, high image density and availability of developed colors of various hues, they have a drawback that preservability of record is poor; that is, the thermally developed color (i.e. record) becomes erased by reaction with a plasticizer or additive contained in a stationery article made of plastics such as polyvinyl chloride, or disappears readily when the record is brought contact with chemicals contained in food or cosmetics, or when the record is exposed to sunlight even for a short period of time. Due to this drawback, the thermosensitive recording materials sustain currently a certain limitation as to their uses, and improvement in record stability or preservance is eagerly desired.

As to thermosensitive recording materials in which, two components react upon heating to develop an image with good preservability, there are disclosed, for example, thermosensitive recording materials comprising an imino compound and an isocyanate compound as the two components in Japanese Patent Application Kokai (Laid-open) Nos. 58-54,085, 58-104,959, 58-149,388, 59-115,887 and 59-115,888, and U.S. Pat. No. 4,521,793.

While these thermosensitive recording materials develop images of good preservability, the developed image is sepia (or dark reddish-brown) in color which is less favored than black as a color of records. With the aim of developing the hue as black as possible, the present inventors disclosed, in the specification of U.S. Ser. No. 07/409,580, a thermosensitive recording material comprising three components of an aromatic isocyanate, an imino compound and a green-colored fluoran compound. As the result of addition of the green-colored fluoran compounds, the hue of the developed color approached black. However, it became apparent as a problem that the background of the recording material tended to yellow or lightly reddish when exposed to light. Moreover, heat response of the material was too poor to obtain recording images of sufficient density on a high speed printer unit like a group III facsimile.

SUMMARY OF THE INVENTION

The object of the present invention is to provide, overcoming the above-mentioned problems, a thermosensitive recording material with excellent image preservability which has an improved heat response (sensitivity) while effectively inhibiting the discoloration of background caused by exposure to light.

DETAILED DESCRIPTION OF PREFERRED EMBODIMENTS

The present inventors have made extensive study to solve the problems mentioned above. As the result, it has been found that the intended thermosensitive recording material can be obtained by using additionally, in a thermosensitive recording material comprising an aromatic isocyanate compound and an imino compound having at least one >C=NH group capable of reacting therewith on heating to develop a color, a fluoran compound (I) represented by the formula:

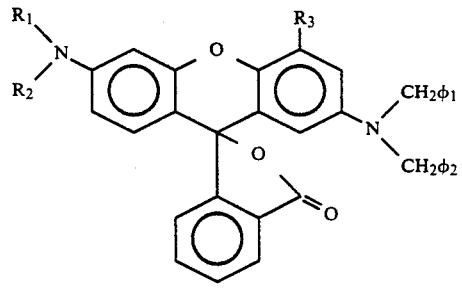

I wherein $R_1$ and $R_2$ each denotes an alkyl group or an alicyclic hydrocarbon group, provided that $R_1$ and $R_2$ may be bonded directly to each other to form an alkylene group in the form of $—R_1—R_2—$; $R_3$ denotes a hydrogen atom or a lower alkyl group, and $\phi_1$ and $\phi_2$ each denotes an aryl group, together with a fluoran compound (II) represented by the formula:

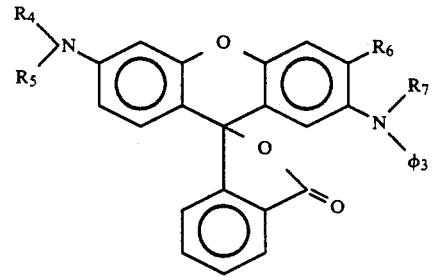

II wherein $R_4$ and $R_5$ each denotes an alkyl group or an alicyclic hydrocarbon group, provided that $R_4$ and $R_5$ may be bonded directly to each other to form an alkylene group in the form of $—R_4—R_5—$, $R_6$ and $R_7$ each denotes a hydrogen atom or a lower alkyl group, and $\phi_3$ denotes an aryl group. The present invention has been accomplished on the basis of above finding.

Although the fluoran compounds (I) and (II) mentioned above are already in wide use as colorless dye precursors, utterly unexpected was the present finding that the aforementioned object can be attained by using the fluoran compounds (I) and (II) in combination in a thermosensitive recording material wherein said isocyanate compound and the imino compound are reacted with each other by heating to develop a color.

As specific examples of the fluoran compound (I) used in the present invention, there may be mentioned 3-diethylamino-7-dibenzylaminofluoran, 3-diethylamino-5-methyl-7-dibenzylaminofluoran, 3-diethylamino-5-ethyl-7-dibenzylaminofluoran, 3-di-n-butylamino-7-dibenzylaminofluoran, 3-di-n-butyloamino- 5-methyl-7-dibenzylaminofluoran, 3-di-n-pentylamino-7-dibenzylaminofluoran, 3-di-n-pentylamino-5-methyl-7-dibenzylaminofluoran, 3-(N-cyclohexyl-N-ethylamino)-7-dibenzylaminofluoran, 3-(N-cyclohexyl-N-ethylamino)-5-methyl-7-dibenzylaminofluoran, 3-pyrrolidino-7-dibenzylaminofluoran, 3-pyrrolidino-5-methyl-7-dibenzylaminofluoran, 3-piperidino-7-dibenzylaminofluoran, 3-piperidino-5-methyl-7-dibenzylaminofluoran, 3-diethylamino-7-(N-benzyl-N-p-methylbenzylamino)fluoran, 3-diethylamino-5-methyl-7-(N-benzyl-N-p-methylbenzylamino)fluoran, etc.

As specific examples of the fluoran compound II used in the present invention, mention may be made of 3-diethylamino-6-methyl-7-anilinofluoran, 3-di-n-butylamino-6-methyl-7-anilinofluoran, 3-di-iso-butylamino-6-methyl-7-anilinofluoran, 3-di-n-pentylamino-6-methyl-7-anilinofluoran, 3-(N-methyl-N-propylamino)-6-methyl-7-anilinofluoran, 3-(N-ethyl-N-iso-butylamino)-6-methyl-7-anilinofluoran, 3-(N-ethyl-iso-pentylamino)-6-methyl-7-anilinofluoran, 3-(N-cyclohexyl-N-methylamino)-6-methyl-7-anilinofluoran, 3-(N-cyclohexyl-N-n-decylamino)-6-methyl-7-anilinofluoran, 3-(N-cyclohexyl-N-n-dodecylamino)-6-methyl-7-anilinofluoran, 3-pyrrolidino-6-methyl-7-anilinofluoran, 3-piperidino-6-methyl-7-anilinofluoran, 3-diethylamino-6-methyl7-(p-ethoxyanilino)fluoran, 3-diethylamino-6-methyl-7-(o,o'-dimethylanilino)fluoran, 3-di-n-butylamino-6-methyl-7-(o,o'-dimethylanilino)-fluoran, 3-pyrrolidino- 6-methyl-7-(p-methylanilino)-fluoran, 3-pyrrolidino-6-methyl-7-(p-butylanilino)fluoran, 3-diethylamino-7-(o-chloroanilino)fluoran, 3-di-n-butylamino-7-(ochloroanilino)fluoran, 3-diethylamino-7-(o-fluoroanilino)fluoran, 3-di-n-butylamino-7-(o-fluoroanilino)fluoran, etc.

The amount of the fluoran compounds I and II to be added in the present invention is usually at least 0.5% by weight in terms of the sum of the amounts of the fluoran compounds I and II based on the amount of said imino compound It is preferably 1–100% by weight, more preferably 3–50% by weight. When the amount added is less than 0.5% by weight the color-toning effect is insufficient, whereas when the amount is more than 100% by weight it is economically disadvantageous.

The ratio of the fluoran compound II to the sum of the fluoran compounds I and II is 5–67 wt.%, preferably 10–50 wt.%. When the ratio of the fluoran compound II is less than 5 wt.%, heat response of the resulting recording material becomes poor; whereas when it is more than 67 wt.%, the color-toning effect is insufficient.

The aromatic isocyanate compounds used in the present invention are aromatic isocyanate compounds or heterocyclic isocyanate compounds which are solid and colorless or light-colored at room temperature. For example, the following isocyanate compounds may be used each alone or as a mixture thereof:

2,6-dichlorophenyl isocyanate, p-chlorophenyl isocyanate, 1,3-phenylene diisocyanate, 1,4-phenylene diisocyanate, 1,3-dimethylbenzene-4,6-diisocyanate, 1,4-dimethylbenzene-2,5-diisocyanate, 1-methoxybenzene-2,4-diisocyanate, 1-methoxybenzene-2,5-diisocyanate, 1-ethoxybenzene-2,4-diisocyanate, 2,5-dimethoxybenzene-1,4-diisocyanate, 2,5-diethoxybenzene-1,4-diisocyanate, 2,5-dibutoxybenzene-1,4-diisocyanate, azobenzene-4,4-diisocyanate, diphenyl ether-4,4'-diisocyanate, naphthalene-1,4-diisocyanate, naphthalene-1,5-diisocyanate, naphthalene-2,6-diisocyanate, naphthalene-2,7-diisocyanate, 3,3'-dimethylbiphenyl-4,4'-diisocyanate, 3,3'-dimethoxybiphenyl-4,4'-diisocyanate, diphenylmethane-4,4'-diisocyanate, diphenyldimethylmethane-4,4'-diisocyanate, benzophenone-3,3'-diisocyanate, fluoren -2,7-diisocyanate, anthraquinone-2,6-diisocyanate, 9-ethylcarbazole-3,6-diisocyanate, pyrene-3,8-diisocyanate, naphthalene-1,3,7-trisiocyanate, biphenyl-2,4,4'-triisocyanate, 4,4',4''-triisocyanato-2,5-dimethoxytriphenylamine, p-dimethylaminophenyl isocyanate, tris(4-phenylisocyanato)thiophosphate, etc.

These isocyanate compounds may also be used, as required, in the form of so-called block isocyanates, which are the addition compounds thereof with phenols, lactams, oximes, etc., in the form of dimers of diisocyanates, e.g. the dimer of 1-methylbenzene-2,4-diisocyanate, in the form of isocyanurates, which are the trimers of isocyanates, or as polyisocyanates, which are the adducts thereof with various polyols.

The imino compounds used in the present invention are those represented by the formula $\phi C{=}N$, where $\phi$ is an aromatic compound residue capable of forming a conjugated system with adjacent C=N, and are colorless or light-colored solids at room temperature. Specific examples of the compounds are shown below. The compounds may be used also in a combination of two or more thereof as occasion demands.

3-Iminoisoindolin-1-one, 3-imino-4,5,6,7-tetrachloroisoindolin-1-one, 3-imino-4,5,6,7-tetrabromoisoindolin-1-one, 3-imino-4,5,6,7-tetrafluoroisoindolin-1-one, 3-imino-5,6-dichloroisoindolin-1-one, 3-imino-4,5,7-trichloro-6-methoxyisoindolin-1-one, 3-imino-4,5,7-trichloro-6-methylmercapto-isoindolin-1-one, 3-imino-6-nitroisoindolin-1-one, 3-iminoisoindolin-1-spirodioxolan, 1,1-dimethoxy-3-iminoisoindoline, 1,1-diethoxy-3-imino-4,5,6,7-tetrachloroisoindoline, 1-ethoxy-3-iminoisoindoline, 1,3-diiminoisoindoline, 1,3-diimino-4,5,6,7-tetrachloroisoindoline, 1,3-diimino-6-methoxyisoindoline, 1,3-diimino-6-cyanoisoindoline, 1,3-diimino-4,7-dithia-5,5,6,6-tetrahydroisoindolin, 7-amino-2,3-dimethyl-5oxopyrrolo[3,4b]pyrazine, 7-amino-2,3-diphenyl-5oxopyrrolo[3,4b]pyrazine, 1-iminonaphthalic acid imide, 1-iminodiphenic acid imide, 1-phenylimino-3-iminoisoindoline, 1-(3'-chlorophenylimino)-3-iminoisoindoline, 1(2',5'-dichlorophenylimino)-3-iminoisoindoline, 1(2',4,5'-trichlorophenylimino)-3-iminoisoindoline, 1-(2'-cyano-4'-nitrophenylimino)-3-iminoisoindoline, 1-(2'-chloro-5'-cyanophenylimino)-3-iminoisoindoline, 1-(2',6'-dichloro-4'-nitrophenylimino)-3-iminoisoindoline, 1-(2',5'-dimethoxyphenylimino)-3-iminoisoindoline, 1-(2',5'-diethoxyphenylimino)-3-iminoisoindoline, 1-((2'-methyl-4'-nitrophenylimino)-3-iminoisoindoline, 1-(5'-chloro-2'-phenoxyphenylimino)-3-iminoisoindoline, 1-(4'-N,N-dimethylaminophenylimino)-3-iminoisoindoline, 1-(3'-N,N-dimethylamino-4'-methoxyphenylimino)-3-iminoisoindoline, 1-(2'-methoxy-5'-N-phenylcarbamoylphenylimino)-3-iminoisoindoline, 1-(2'-chloro-5'-trifluoromethylimino)-3-iminoisoindoline, 1-(5',6'-dichlorobenzothiazolyl-2'-imino)-3-iminoisoindoline, 1-(6'-methylbenzothiazolyl-2'-imino)-3-iminoisoindoline, 1-(4'-phenylaminophenylimino)-3-iminoisoindoline, 1-(p-phenylazophenylimino)-3-iminoisoindoline, 1-(anthraquinone-1'-imino)-3-iminoisoindoline, 1-(naphthyl-1'-imino)-3-iminoisoindoline, 1-(5'-chloroanthraquinone-1'-imino)-3-iminoisoindoline, 1-(N-ethylcarbazolyl-3'-imino)-3-iminoisoindoline, 1-(naphthoquinone-1'-imino)-3-iminoisoindoline, 1-(pyridyl-4'-imino)-3-iminoisoindoline, 1-(benzimidazolone-6'-imino)-3-iminoisoindoline, 1-(1'-methylbenzimidazolone-6'-imino)-3-iminoisoindoline, 1-(7'-chlorobenzimidazolone-5'-imino)-3-iminoisoindoline, 1-(benzimidazolyl-2'-imino)-3-iminoisoindoline, 1-(benzimidazolyl-2'-imino)-3-imino-4,5,6,7-tetrachloroisoindoline, 1-(2',4'-dinitrophenylhydrazone)-3-iminoisoindoline, 1-(indazolyl-3'-imino)-3-iminoisoindoline, 1-(indazolyl-3'-imino)-3-imino-4,5,6,7-tetrabromoisoindoline, 1-(indazolyl-3'-imino)-3-imino-4,5,6,7-tetrafluoroisoindoline, 1-(benzimidazolyl-2'-imino)-3-imino-4,7-dithiatetrahydroisoindoline, 1-(4',5'-dicyanoimidazolyl-2'-imino)-3-imino-5,6-dimethyl-4,7-pyraziisoindoline, 1-(cyanobenzoylmethylene)-3-iminoisoindoline, 1-(cyanocarbonamidomethylene)-3-iminoisoindoline, 1-(cyanocarbomethoxymethylene)-3-iminoisoindoline, 1-(cyanocarboethoxymethylene)-3-immoisoindoline, 1-(cyano-N-phenylcarbamoylmethylene)-3-iminoisoindoline, 1-[cyano-N-(3'-methylphenyl)carbamoylmethylene]-3-iminoisoindoline, 1-[cyano-N-(4'-chlorophenyl)-carbamonylmethylene]-3-iminoisoindoline, 1-[cyano-N-(4'-methoxyphenyl)-carbamoylmethylene]-3-iminoisoindoline, 1-[cyano-N-(3'-chloro-4'-methylphenyl)-carbamoylmethylene]-3-iminoisoindoline, 1-(cyano-p-nitrophenylmethylene)-3-iminoisoindoline, 1-(dicyanomethylene)-3-iminoisoindoline, 1-(cyano-1',2',4'-triazolyl-(3')-carbamoylmethylene)-3-iminoisoindoline, 1-(cyanothiazoyl-(2')-carbamoylmethylene)-3-iminoisoindoline, 1-(cyanobenzimidazolyl-(2')-carbamoylmethylene)-3-iminoisoindoline, 1-(cyanobenzothiazolyl-(2')-carbamoylmethylene)-3-iminoisoindoline, 1-[(cyanobenzimidazolyl-2')-methylene]-3-iminoisoindoline, 1-[(cyanobenzimidazolyl-2')-methylene]-3-imino-4,5,6,7-tetrachloroisoindoline, 1-[(cyanobenzimidazolyl-2')-methylene]-3-imino-5-methoxyisoindoline, 1-[(cyanobenzyimidazolyl-2')-methylene]-3-imino-6-chloroisoindoline, 1-[(1'-phenyl-3'-methyl-5-oxo)pyrazolidene-4']-3-iminoisoindoline, 1-[(cyanobenzimidazolyl-2') -methylene]-3-imino-4,7-dithiotetrahydroisoindoline, 1-[(cyanobenzimidazolyl-2')methylene]-3-imino-5,6-dimethyl-4,7-pyraziisoindoline, 1-[(1'-methyl-3'-n-butyl)-barbituric acid-5']-3-iminoisoindoline, 3-imino-1-sulfobenzoic acid imide, 3-imino-1-sulfo-6-chlorobenzoic acid imide, 3-imino-1-sulfo-5,6-dichlorobenzoic acid imide, 3-imino-1-sulfo-4,5,6,7-tetrachlorobenzoic acid imide, 3-imino-1-sulfo-4,5,6,7-tetrabromobenzoic acid imide, 3-imino-1-sulfo-4,5,6,7-tetrafluorobenzoic acid imide, 3-imino-1-sulfo-6-nitrobenzoic acid imide, 3-imino-1-sulfo-6-methoxybenzoic acid imide, 3-imino-1-sulfo-4,5,7-trichloro-6-methylmercaptobenzoic acid imide, 3-imino-1-sulfonaphthoic acid imide, 3-imino-1-sulfo-5-bromonaphthoic acid imide, 3-imino-2-methyl-4,5,6,7-tetrachloroisoindolin-1-one, etc.

These isocyanate compounds and imino compounds may be used according to conventional methods.

The thermosensitive recording material according to the present invention may be incorporated with a heat-fusible compound to improve its heat response. Heat-fusible compounds having a melting point of 60°-180° C. are preferable, and those having a melting point of 80°-140° C. are more preferable. As specific examples of the heat-fusible compound (i.e., sensitizer) for improving the heat response, there may be mentioned N-hydroxymethylstearic acid amide, stearic acid amide, palmitic acid amide, oleic acid amide, ethylenebisstearic acid amide, ricinolic acid amide, waxes such as paraffin wax, microcrystalline wax, polyethylene wax, rice wax, carnauba wax, etc., naphthol derivatives such as 2-benzyloxynaphthalene, etc., biphenyl derivatives such as p-benzylbiphenyl, 4-allyloxybiphenyl, etc., polyether compounds such as 1,2-bis(3-methylphenoxy)ethane, 2,2'-bis(4-methoxyphenoxy)diethyl ether, bis(4-methoxyphenyl)ether, etc., carbonic acid or oxalic acid diester derivatives such as diphenyl carbonate, dibenzyl oxalate, di(p-chlorobenzyl)oxyalate, etc. These sensitizers may be used each alone or as a mixture of two or more thereof. To obtain a satisfactory heat response, the sensitizer is used in an amount of preferably 10-300% by weight, more preferably 20-250% by weight, relative to the aromatic isocyanate compound.

The thermosensitive recording material according to the present invention may further contain an aniline derivative having at least one amino group described in International Application W087/06885 filed by the present inventors. The aniline derivative is effective in inhibiting the fogging of the background. Examples of said aniline derivative include methyl p-aminobenzoate, ethyl p-aminobenzoate, n-propyl p-aminobenzoate, isopropyl p-aminobenzoate, butyl p-aminobenzoate, dodecyl p-aminobenzoate, benzyl p-aminobenzoate, o-aminobenzophenone, m-aminoacetophenone, p-aminoacetophenone, m-aminobenzamide, o-aminobenzamide, p-aminobenzamide, p-amino-N-methylbenzamide, 3-amino-4-methylbenzamide, 3-amino-4-methoxybenzamide, 3-amino-4-chlorobenzamide, p-(N-phenylcarbamoyl)aniline, p-[N-(4-chlorophenyl)carbamoyl]aniline, p-[N-(4-aminophenyl)carbamoyl]aniline, 2-methoxy-5-(N-phenylcarbamoyl)aniline, 2-methoxy-5-[N-(2'-methyl-3'-chlorophenyl)carbamoyl]aniline, 2-methoxy-5-[N-(2'-chlorophenyl)carbamoyl]aniline, 5-acetylamino-2-methoxyaniline, 4-acetylaminoaniline, 4-(N-methyl-N-acetylamino)aniline, 2,5-dimethoxy-4-(N-benzoylamino)aniline, 2,5-diethoxy-4-(N-benzoylamino)aniline, 2-methoxy-4-(N-benzoylamino)-5-methylaniline, 4-sulfamoylaniline, 3-sulfamoylaniline, 2-(N-ethyl-N-phenylaminosulfonyl)aniline, 4-dimethylaminosulfonylaniline, 4-diethylaminosulfonylaniline, sulfathiazole, 4-aminodiphenyl sulfone, 2-chloro-5-N-phenylsulfamoylaniline, 2-methoxy-5-N,N-diethylsulfamoylaniline, 2,5-dimethoxy-4-N-phenylsulfamoylaniline, 2-methoxy-5-benzylsulfonylaniline, 2-phenoxysulfonylaniline, 2-(2'-chlorophenoxy)sulfonylaniline, 3-anilinosulfonyl-4-methylaniline, bis[4-(m-aminophenoxy)phenyl]sulfone, bis[4-(p-aminophenoxy)phenyl]sulfone, bis[3-methyl-4-(p-aminophenoxy)phenyl]sulfone, 3,3'-dimethoxy-4,4'-diaminobiphenyl, 3,3'-dimethyl-4,4'-diaminobiphenyl, 2,2'-dichloro-4,4'-diamino-5,5'-dimethoxybiphenol, 2,2',5,5'-tetrachloro-4,4'-diaminobiphenyl, o-tolidine sulfone, 2,4'-diaminobiphenyl, 2,2'-diaminobiphenyl, 4,4'-diaminobiphenyl, 2,2'-dichloro-4,4'-diaminobiphenyl, 3,3'-dichloro-4,4'-diaminobiphenyl, 2,2'-dimethyl-4,4'-diaminobiphenyl, 4,4'-thiodianiline, 2,2'-thiodianiline, 4,4'-dithiodianiline, 4,4'-diaminodiphenyl ether, 3,3'-diaminodiphenyl ether, 3,4'-diaminodiphenyl ether, 4,4'-diaminodiphenylmethane, 3,4'-diaminodiphenylmethane, bis(3-amino-4-chlorophenyl)sulfone, bis(3,4-diaminophenyl)sulfone, bis(3-aminophenyl)sulfone, bis(4-aminoiphenyl)sulfone, 3,4'-diaminodiphenyl sulfone, 3,3'-diaminodiphenylmethane, 4,4'-ethylenedianiline, 4,4'-diamino-2,2'-dimethyldibenzyl, 4,4'-diamino-3,3'-dichlorodiphenylmethane, 3,3'-diaminobenzophenone, 4,4'-diaminobenzophenone, 1,4-bis(4-aminophenoxy)benzene, 1,3-bis(4-aminophenoxy)benzene, 1,3-bis(3-aminophenoxy)benzene, 9,9-bis(4-aminophenoxy)fluoran, 2,2-bis(4-aminophenoxyphenyl)propane, 4,4'-bis(4-aminophenoxy)diphenyl, 3,3',4,4'-tetraaminodiphenyl ether, 3,3',4,4'-tetraaminodiphenyl sulfone, 3,3',4,4'-tetraaminobenzophenone, etc.

Further, to improve the inhibition of fogging of the uncolored part and to improve the heat response, there may be added phenolic compounds as listed below: N-stearyl-N'-(2-hydroxyphenyl)urea, N-stearyl-N'-(3-hydroxyphenyl)urea, N-stearyl-N'-(4-hydroxyphenyl-)urea, p-stearoylaminophenol, o-stearoylaminophenol, p-lauroylaminophenol, p-butyrylaminophenol, m-acetylaminophenol, o-acetylaminophenol, p-acetylaminophenol, o-butylaminocarbonylphenol, o-stearylaminocarbonylphenol, p-stearylaminocarbonylphenol, 1,1,3-tris(3-tert-butyl-4-hydroxy-6-methylphenyl)butane, 1,1,3-tris(3-tert-butyl-4-hydroxy-6-ethylphenyl)butane, 1,1,3-tris(3,5-di-tert-butyl-4-hydroxyphenyl)butane, 1,1,3-tris(3-tert-butyl-4-hydroxy-6-methylphenyl)propane, 1,2,3-tris(3-tert-butyl-4-hydroxy-6-methylphenyl)butane, 1,1,3-tris(3-phenyl-4-hydroxyphenyl)butane, 1,1,3-tris(3-cyclohexyl-4-hydroxy-5-methylphenyl)butane, 1,1,3-tris(3-cyclohexyl-4-hydroxy-6-methylphenyl)butane, 1,1,3,3-tetra(3-phenyl-4-hydroxyphenyl)propane, 1,1,3,3-tetra(3-cyclohexyl-4-hydroxy-6-methylphenyl)propane, 1,1-bis(3-tert-butyl-4-hydroxy-6-methylphenyl)butane, 1,1-bis(3-cyclohexyl-4-hydroxy-6-methylphenyl)butane, etc.

In the thermosensitive recording layer, there may be used as pigments diatomaceous earth, talc, kaolin, calcined kaolin, calcium carbonate, magnesium carbonate, titanium oxide, zinc oxide, silicon oxide, aluminum hydroxide, urea-formaldehyde resin, etc. Further, there may be added, for the purpose of preventing sticking and abrasion of a thermal head, metal salts of higher fatty acids such as zinc stearate, calcium stearate, etc., and waxes such as paraffin, oxidized paraffin, polyethylene, oxidized polyethylene, stearic acid amide, castor wax, etc. There may also be added to the thermosensitive recording layer, as required, dispersing agents such as sodium dioctylsulfosuccinate etc., ultraviolet absorbers of benzophenone type, benzotriazole type, etc., surfactants, fluorescent dyes, and so forth.

The binder used in the thermosensitive recording layer may be conventionally used ones of various kinds. As specific examples, mention may be made of water soluble binders such as starches, hydroxyethyl cellulose, methyl cellulose, carboxymethyl cellulose, gelatin, casein, poly(vinyl alcohol), modified poly(vinyl alcohol), sodium polyacrylate, acrylamide/acrylic ester copolymer, acrylamide/acrylic ester/methacrylic acid terpolymer, alkali metal salts of styrene/maleic anhydride copolymer, alkali metal salts of ethylene/maleic anhydride copolymer, etc. and latex-base water insoluble binders such as styrene/butadiene copolymer, acrylonitrile/butadiene copolymer, methyl acrylate/-butadiene copolymer, etc.

The thermosensitive recording material of the present invention comprises a substrate and a thermosensitive recording layer which develops a color upon heating provided thereon. Although paper is mainly used as the substrate, various woven fabrics, non-woven fabrics, synthetic resin film, laminated paper, synthetic paper, metal foil, or composite sheets formed of combination of these may also be used as desired according to intended purposes. The thermosensitive recording layer may be either of a single layer structure or of a multi-layer structure formed of plural layers. For example, it may have a multi-layer structure in which each of the color-developing components is contained in the respective single layer. A protective layer may also be provided on the thermosensitive recording layer. The thermosensitive recording layer may be obtained by milling the respective color-developing components and other components to give aqueous dispersions, mixing the respective aqueous dispersions with a binder etc., and coating the mixture(s) on a substrate, followed by drying.

EXAMPLES

The present invention will be further described in detail below with reference to Examples.

Example 1

1,3-Diimino-4,5,6,7-tetrachloroisoindoline, weighing 15 g, was dispersed together with 60 g of 1% aqueous poly(vinyl alcohol) solution in a ball mill for 24 hours. Separately, 10 g of 4,4',4''-triisocyanato-2,5-dimethoxytriphenylamine was dispersed together with 40 g of 1% aqueous poly(vinyl alcohol) solution in a ball mill for 24 hours. Further, 1.0 g of 3-diethylamino-5-methyl-7-dibenzylaminofluoran and 0.5 g of 3-pyrrolidino-6-methyl-7-anilinofluoran were dispersed together with 15 g of 1% aqueous poly(vinyl alcohol) solution in a ball mill for 24 hours.

The three aqueous dispersions obtained above were mixed together, then 150 g of 40% aqueous dispersion of calcium carbonate was added thereto, and further 50 g of 30% aqueous dispersion of zinc stearate, 100 g of 20% aqueous dispersion of 2-benzyloxynaphthalene, 100 g of 10% aqueous poly(vinyl alcohol) solution and 55 g of water were added. The resulting mixture was stirred thoroughly to give a coating liquor. The coating liquor was applied onto a base paper of a basis weight of 50 g/m$^2$ so as to give a solid coating weight of 5.8 g/m$^2$, then dried, and processed by a supercalender to obtain a thermosensitive recording material.

Example 2

A thermosensitive recording material was obtained in the same manner as in Example 1 except for using 3-diethylamino-7-dibenzylaminofluoran in place of 3-diethylamino-5-methyl-7-dibenzylaminofluoran.

Examples 3 to 6

Thermosensitive recording materials were obtained in the same manner as in Example 1 except for using 3-(N-methyl-N-n-propyl)amino-6-methyl-7-anilinofluoran (Example 3), 3-diethylamino-6-methyl-7-anilinofluoran (Example 4), 3-dibutylamino-6-methyl-7-anilinofluoran (Example 5), or 3-di-n-butylamino-7-(o-fluoroanilino)fluoran (Example 6) in place of 3-pyrrolidino-6-methyl-7-anilinofluoran, respectively.

Examples 7 and 8

Thermosensitive recording materials were obtained in the same manner as in Example 1 except for using 3.75 g of 3-diethylamino-5-methyl-7-dibenzylaminofluoran and 3.75 g of 3-pyrrolidino-6-methyl-7-anilinofluoran (Example 7) or using 0.405 g of 3-diethylamino-5-methyl-7-dibenzylaminofluoran and 0.045 g of 3-pyrrolidino-6-methyl-7-anilinofluoran (Example 8) in place of 1.0 g of 3-diethylamino-5-methyl-7-dibenzylaminofluoran and 0.5 g of 3-pyrrolidino-6-methyl-anilinofluoran used in Example 1, respectively.

COMPARATIVE EXAMPLES 1 AND 2

Thermosensitive recording materials were obtained in the same manner as in Example 1 except for using 1.5 g of 3-diethylamino-5-methyl-7-dibenzylaminofluoran (Comparative Example 1) or 1.5 g of 3-pyrrolidino-6-methyl-7-anilinofluoran (Comparative Example 2) respectively in place of 1.0 g of 3-diethylamino-5-methyl-7-dibenzylaminofluoran and 0.5 g of 3-pyrrolidino-6-methyl-7-anilinofluoran used in combination in Example 1.

TEST 1

The thermosensitive recording materials obtained in Examples 1 to 8 and Comparative Examples 1 and 2 were each printed using a thermal facsimile printing tester at an applied energy of 0.67 mJ, and the optical density of the developed color image was measured by a Macbeth densitometer RD918. The result obtained are shown in Table 1. The developed color thus obtained was toned to black.

TEST 2

The background parts (unprinted parts) of the thermosensitive recording materials obtained in Examples 1 to 8 and Comparative Examples 1 and 2 were allowed to stand under a fluorescent light at an illuminance of 20,000 Lux for 5 days. The hues of the background of the exposed part and the unexposed part were determined with a Minolta color-color difference meter CR-121. The value ΔE*ab shown in Table 1 is expressed by the following equation and indicates the extent of discoloration of the background. The smaller value of ΔE*ab signifies the less discoloration caused by exposure to light.

$$\Delta E^*ab=\{(L^*-L_0^*)^2+(a^*-a_0^*)^2+(b^*-b_0^*)^2\}^{\frac{1}{2}}$$

wherein L*, a* and b* are the CIE equal perception color space parameters of the background part exposed to light, and $L_0^*$, $a_0^*$ and $b_0^*$ are the CIE equal perception color space parameters of the background part not exposed to light.

TABLE 1

| | Test 1 Optical density | Test 2 ΔE*ab |
|---|---|---|
| Example 1 | 1.11 | 7.2 |
| Example 2 | 1.09 | 7.8 |
| Example 3 | 1.05 | 7.3 |
| Example 4 | 1.03 | 7.7 |
| Example 5 | 1.02 | 6.6 |
| Example 6 | 1.03 | 7.3 |
| Example 7 | 1.25 | 8.0 |
| Example 8 | 1.00 | 3.2 |
| Comparative Example 1 | 0.90 | 10.5 |
| Comparative Example 2 | 0.95 | 9.2 |

As set forth heretofore, a thermosensitivity recording material, which develops image successfully toned to black and which exhibits excellent image preservability and improved heat response (sensitivity) while inhibiting discoloration of the background caused by exposure to light, can be obtained by using the fluoran compounds I and II in combination as color toning dyes in a two components thermal color forming system comprising an aromatic isocyanate compound and an imino compound having at least one >C=NH group.

What is claimed is:

1. A thermosensitive recording material comprising a substrate and a thermosensitive recording layer which contains an aromatic isocyanate compound, an imino compound having at least one >C=NH group capable of reacting therewith upon heating to develop a color, a fluoran compound I represented by the formula:

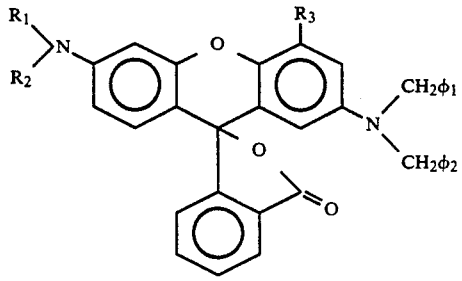

I wherein $R_1$ and $R_2$ each denotes an alkyl group or an alicyclic hydrocarbon group, provided that $R_1$ and $R_2$ may be bonded directly to each other to give an alkylene group in the form of $—R_1—R_2—$, $R_3$ denotes a hydrogen atom or a lower alkyl group, and $\phi_1$ and $\phi_2$ each denotes an aryl group, and a fluoran compound II represented by the formula:

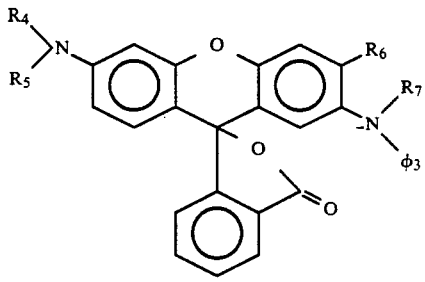

II wherein $R_4$ and $R_5$ each denotes an alkyl group or an alicyclic hydrocarbon group, provided that $R_4$ and $R_5$ may be bonded directly to each other to give an alkylene group in the form of $—R_4—R_5—$, $R_6$ and $R_7$ each denotes a hydrogen atom or a lower alkyl group, and $\phi_3$ denotes an aryl group wherein the fluoran compounds I and II are contained in a total amount of at least 0.5 percent by weight relative to the imino compound, and wherein the amount of the fluoran compound I in the sum of the fluoran compounds I and II is 5 to 67 percent by weight.

2. A thermosensitive recording material according to claim 1 wherein the total amount of the fluoran compounds I and II is 1-100% by weight relative to the imino compound.

3. A thermosensitive recording material according to claim 1 wherein said amount of the compound I is 10 percent by weight to 50 percent by weight.

4. A thermosensitive recording material according to claim 1 which further contains in the thermosensitive recording layer a heat-fusible compound having a melting point of 60°-180° C.

* * * * *